US005540170A

United States Patent [19]

Purdy

[11] Patent Number: 5,540,170

[45] Date of Patent: Jul. 30, 1996

[54] MULTI-HULL MARINE VESSEL WITH RETRACTABLE OUTER HULLS

[76] Inventor: Peter K. Purdy, 13420 - 12th Ave. NE., Lake Stevens, Wash. 98258

[21] Appl. No.: 291,985

[22] Filed: Aug. 17, 1994

[51] Int. Cl.[6] ..... B63B 1/00

[52] U.S. Cl. ..... 114/061; 114/125; 114/39.1

[58] Field of Search ..... 114/121, 123, 114/125, 39.1, 61, 283, 68, 343

[56] References Cited

U.S. PATENT DOCUMENTS

| | | | |
|---|---|---|---|
| 1,185,494 | 5/1916 | Friberg | 114/123 |
| 1,710,625 | 4/1929 | Kapigian | 114/123 |
| 3,276,413 | 10/1966 | Dolph et al. | 114/123 |
| 3,304,898 | 2/1967 | Sainte-Claire | 114/125 |
| 3,559,610 | 2/1971 | Viollet | 114/125 |
| 3,960,102 | 6/1976 | Davy | 114/123 |
| 3,996,874 | 12/1976 | Winch | 114/123 |
| 4,441,445 | 4/1984 | De Weck | 114/125 |
| 4,562,785 | 1/1986 | Priam-Doizi | 114/123 |
| 4,730,570 | 3/1988 | Harris | 114/61 |
| 4,836,120 | 6/1989 | Murphy | 114/39.1 |

FOREIGN PATENT DOCUMENTS

| | | | |
|---|---|---|---|
| 2662658 | 12/1991 | France | 114/123 |

OTHER PUBLICATIONS

P.C. Mould Ltd., "Contour 30 Swing Wing Trimaran." advertisement, n.d.

Corsair Marine, Inc., "Corsair F–27." advertisement, n.d.

*Primary Examiner*—Edwin L. Swinehart

*Attorney, Agent, or Firm*—Seed and Berry LLP

[57] ABSTRACT

A multi-hull marine vessel having a center hull and a left and right outer hull movably positioned adjacent to the center hull. The outer hulls are on opposite sides of the center hull and are generally parallel to the center hull. Extendible support assemblies extend between the center hull and the outer hulls. The extendible support assemblies are movable between a retracted position with the outer hulls in nested positions immediately adjacent to the center hull, and extended positions with the outer hulls in outward positions away from the center hull. A support moving device is connected to the extendible support assemblies and is positioned to move the extendible support assemblies between the retracted and extended positions, thereby moving the outer hulls between the nested and outward positions. The center hull has a water ballast tank therein that is adapted to be filled with water, such that the multi-hull vessel is a self-righting vessel that will right itself from an overturned position when the water tank ballast is filled and the outer hulls are in the nested position. The outer hulls are sealed hulls with positive buoyancy to provide an unsinkable, ballasted, multi-hull marine vessel.

3 Claims, 7 Drawing Sheets

MULTI-HULL MARINE VESSEL WITH RETRACTABLE OUTER HULLS

TECHNICAL FIELD

The present invention is directed toward marine vessels, and more particularly toward multi-hull marine vessels.

BACKGROUND OF THE INVENTION

Multi-hull marine vessels such as catamaran sailboats and powerboats, with two hulls, and trimaran sailboats and powerboats, with three hulls, have been known in the art for a long period of time and have become very popular boats. Their popularity is, in part, because they are faster on a reach or a downwind run, they are more stable, and they are easier to sail than mono-hull boats. The larger trimarans are popular because of a large amount of upper deck space as compared to a similarly sized mono-hull boat.

However, the conventional catamarans and trimarans have significant drawbacks. A trimaran sailboat can be more difficult to sail upwind because it is a lighter weight vessel than a similarly sized mono-hull vessel, and the wind and waves coming at the trimaran will impede upwind travel. The superstructure of the trimaran can be subjected to very high forces when traveling upwind due to the vessel's cantilevered hulls. Trimarans are, however, very fast on a reach or on a downwind run. Mono-hull sailboats, on the other hand, have less superstructure that can cause excess windage when going to weather and that can cause large moment arm forces on the vessel. As a result, the mono-hull vessels are significantly more efficient at sailing upwind and have significant benefits in heavy weather windward sailing due to their ballast which allows the vessel to carry way even when hit with wind and waves.

Multi-hull vessels are typically less maneuverable, particularly at slow speeds, than mono-hull boats of similar size, because the multi-hull vessels have a substantially wider beam than the mono-hull vessels. Accordingly, maneuvering a trimaran in a tight area, such as is common in marinas and the like, is very difficult. The multi-hull vessels also encounter significant moorage and trailering problems because of the wide beam. It is often difficult to find a slip within a marina that has sufficient width to receive a wide vessel, and wide moorage slips are generally more expensive than narrow moorage slips. Trailering a wide beam vessel requires a suitable trailer, and such a trailer is generally more expensive than trailering a narrower boat.

Non-ballasted trimarans having been developed to avoid the problems of mooring or trailering a wide beamed vessel by providing folding outer amas that fold back or up relative to the center hull. However, these outer areas become non-structural members when they are folded back or up such that the folded trimaran is configured in a manner that is not suitable for sailing and is only suitable for mooring, storing, or trailering the vessel.

The wide beam of the conventional trimarans and catamarans provide high initial stability such that the multi-hull vessels are very stable when in the upright position and are very difficult to overturn and capsize or become inverted. Mono-hull vessels, in contrast, have a narrower beam and have a low initial stability such that it is easier for the mono-hull vessels to capsize or become inverted. Trimarans and catamarans do not have ballast in the hulls, so they have low ultimate stability and once the vessels begin to overturn, it is very difficult to prevent the vessels from overturning. In contrast, mono-hull vessels have substantial ballast in the keel, so as to provide high ultimate stability whereby the ballast will try to force the mono-hull vessel back to the upright position when the vessel begins to overturn.

A further drawback of the trimarans and catamarans is the fact that they are very difficult to right when the vessels do capsize or become inverted. As a result of the high initial stability, a trimaran or catamaran is just as stable in the inverted position as it is in the upright position. Thus, the high initial stability must be overcome before the vessel can be righted, and a significant amount of force must be exerted on the vessel in order to overcome the vessel's high initial stability. Unlike the multi-hull vessels, a mono-hull vessel is significantly easier to right because of the low initial stability due to the substantial ballast keel. The ballast keel typically has 25%–60% or more of the entire weight of the mono-hull vessel, such that, when the ballast keel lifts above the water, the ballast keel forces the mono-hull vessel to the upright position with the keel down. Accordingly, the ballast keel facilitates righting the mono-hull vessel once the low initial stability is overcome.

Although the conventional multi-hull vessels are difficult to right when overturned, a benefit of the multi-hull vessels is that the outer hulls will float when the vessel is inverted even if the center hull is completely flooded. In contrast, a ballasted mono-hull vessel, which is typically ballasted with lead or steel in the keel, will sink when it is capsized or inverted and the cabin becomes flooded.

SUMMARY OF THE INVENTION

The present invention overcomes the problems experienced by the conventional marine vessels by providing a multi-hull marine vessel having a main hull connected to at least one retractable outer hull. The retractable outer hull is linearly movable relative to the main hull between a nested position, wherein the outer hull is positioned adjacent to the main hull, and an outward position, wherein the outer hull is positioned outward away from the main hull. In a preferred embodiment of the invention, a multi-hull marine vessel has a first hull that is generally parallel to a second hull which is movably located adjacent to the first hull. An extendible support member spans between the first and second hulls with first end of the support member attached to the first hull and a second end attached to the second hull. The extendible support member is linearly movable between a retracted position with the second hull nested immediately adjacent to the first hull, and an extended position with the second hull in an outward position away from the first hull. A support moving device is connected to the extendible support member and is adapted to move the extendible support member between the retracted and extended positions, thereby moving the second hull between the nested and outward positions.

In one embodiment of the invention, the multi-hull marine vessel has a first center hull and two outer hulls on opposite sides of the center hull. Telescopically extendible support members span between the center hull and each of the outer hulls. The support members are transverse to the longitudinal axes of the hulls, and the support members are adapted to simultaneously extend or retract to move the outer hulls between the retracted and outward positions to keep the outer hulls parallel to the center hull. Thus, the present invention provides a multi-hull marine vessel having at least one retractable or collapsible outer hull that provides structural member suitable for sailing in the outward or nested positions, such that the beam of the marine vessel is adjustable.

The multi-hull marine vessel of the preferred embodiment is a self-righting vessel having a water ballast chamber or tank in the bottom portion of the center hull. The water ballast tank is adapted to receive water therein to add weight to the bottom of the vessel. A pump is mounted to the center hull and coupled to the water ballast tank, and the pump adds or withdraws water from the water ballast tank as desired by a user to increase or decrease the ballast in the center hull. The water ballast tank in the center hull provides a self-righting feature, whereby the multi-hull vessel will right itself when the vessel overturns and the water ballast tank is filled and the outer hulls are retracted from the outward position to the nested position.

Accordingly, the multi-hull marine vessel of the present invention achieves the benefits of a ballasted mono-hull vessel while maintaining the benefits of a multi-hull vessel and while avoiding the drawbacks of the both the ballasted mono-hull vessel and the conventional multi-hull vessels with fixed outer hulls.

DETAILED DESCRIPTION OF THE INVENTION

Figure 1:
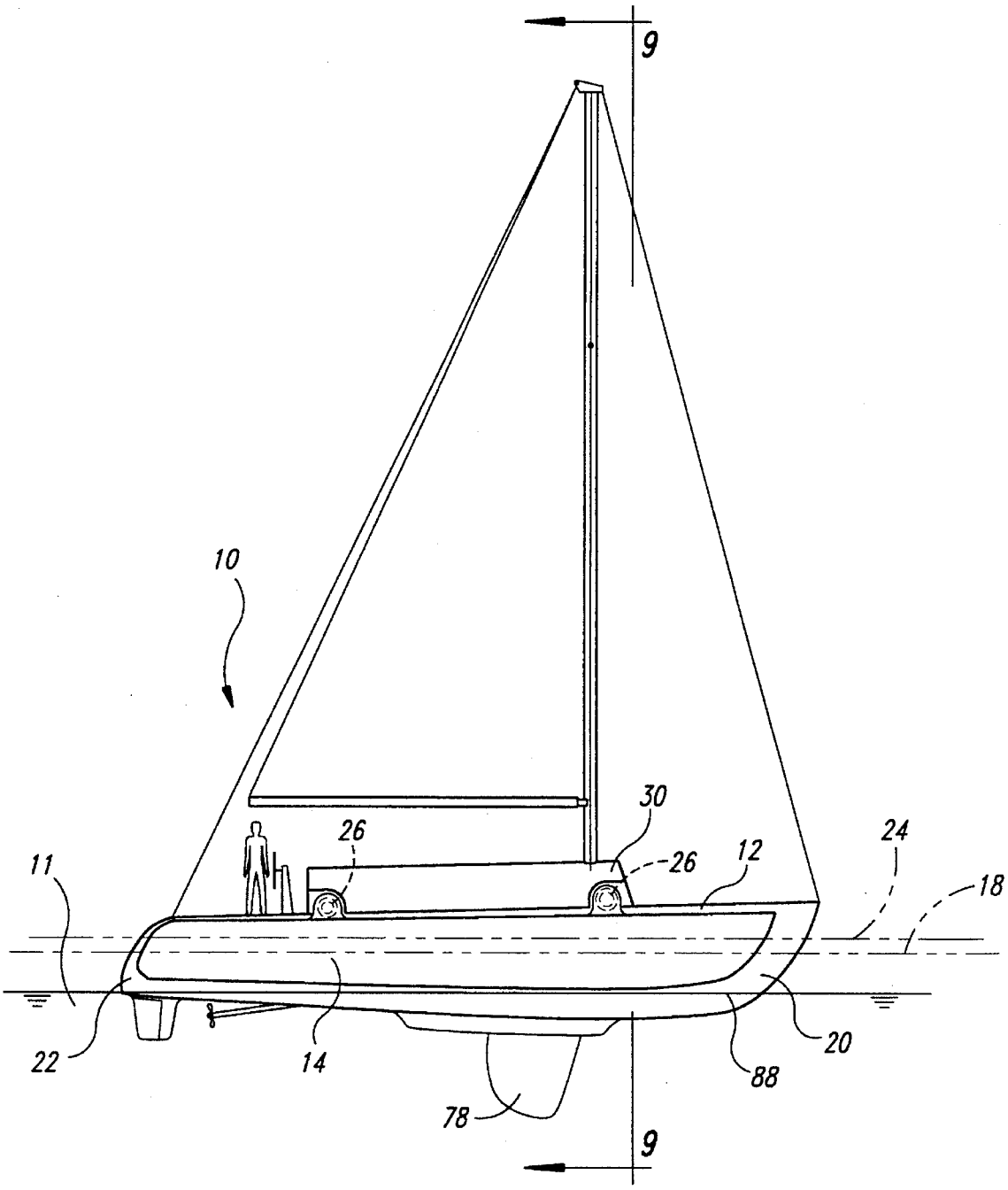
FIG. 1 is a right side elevation view of a multi-hull marine vessel in accordance with the present invention, with the vessel shown floating in a body of water.
Figure 2:
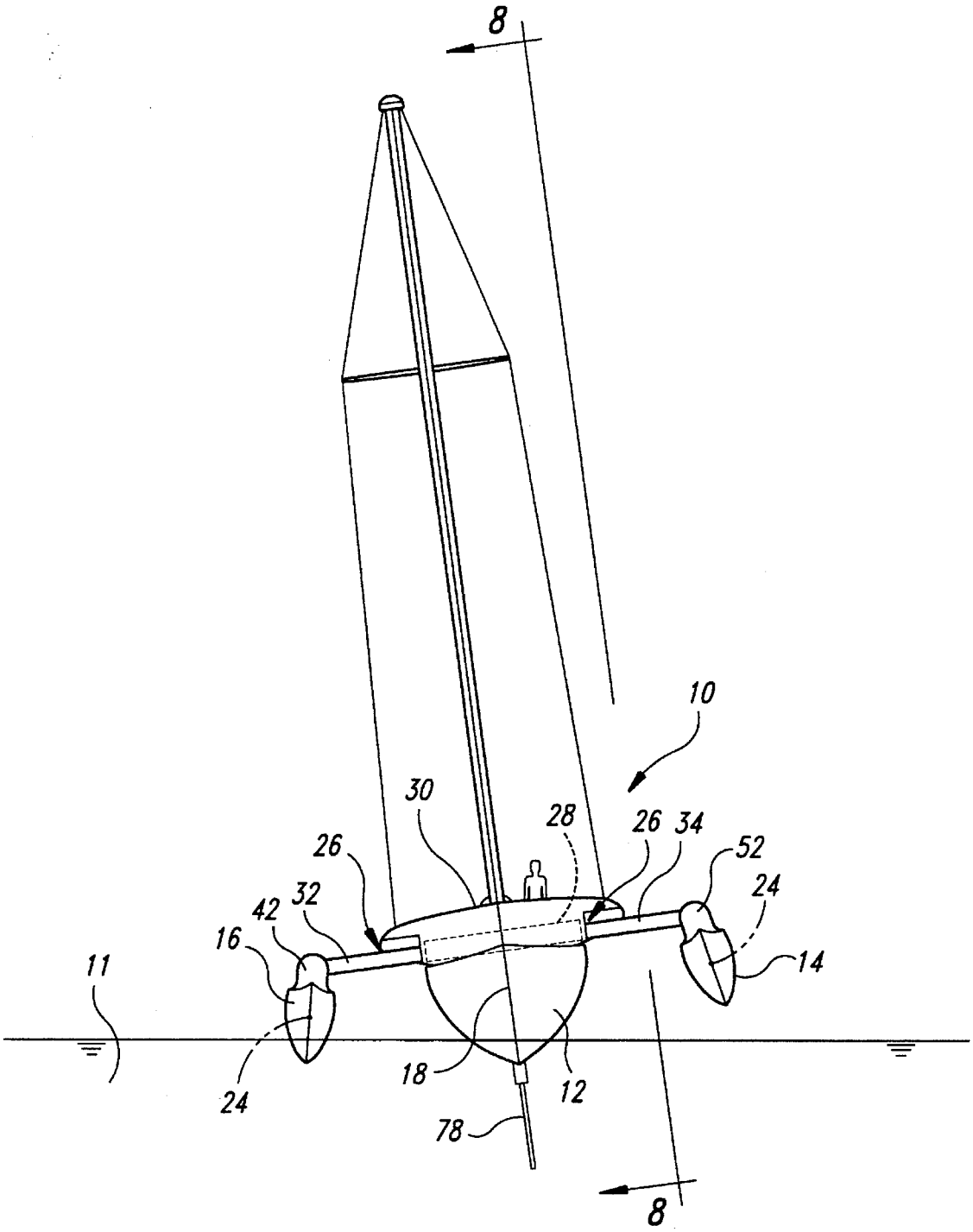
FIG. 2 is a rear side elevation view of the multi-hull marine vessel of FIG. 1, with outer hulls shown in an outward position away from the center hull.

As shown in the drawings for purposes of illustration, the present invention is embodied in a trimaran boat 10 that is shown floating right-side up in a body of water 11. As best seen in FIGS. 1 and 2, the trimaran 10 is a sailing vessel having a center hull 12, a right outer hull 14 on the starboard side of the center hull, and a left outer hull 16 on the port side of the center hull (FIG. 2). The center hull 12 includes a longitudinal axis 18 that extends fore and aft between the bow 20 and the stern 22 (FIG. 1 ) of the center hull.

Figure 3:
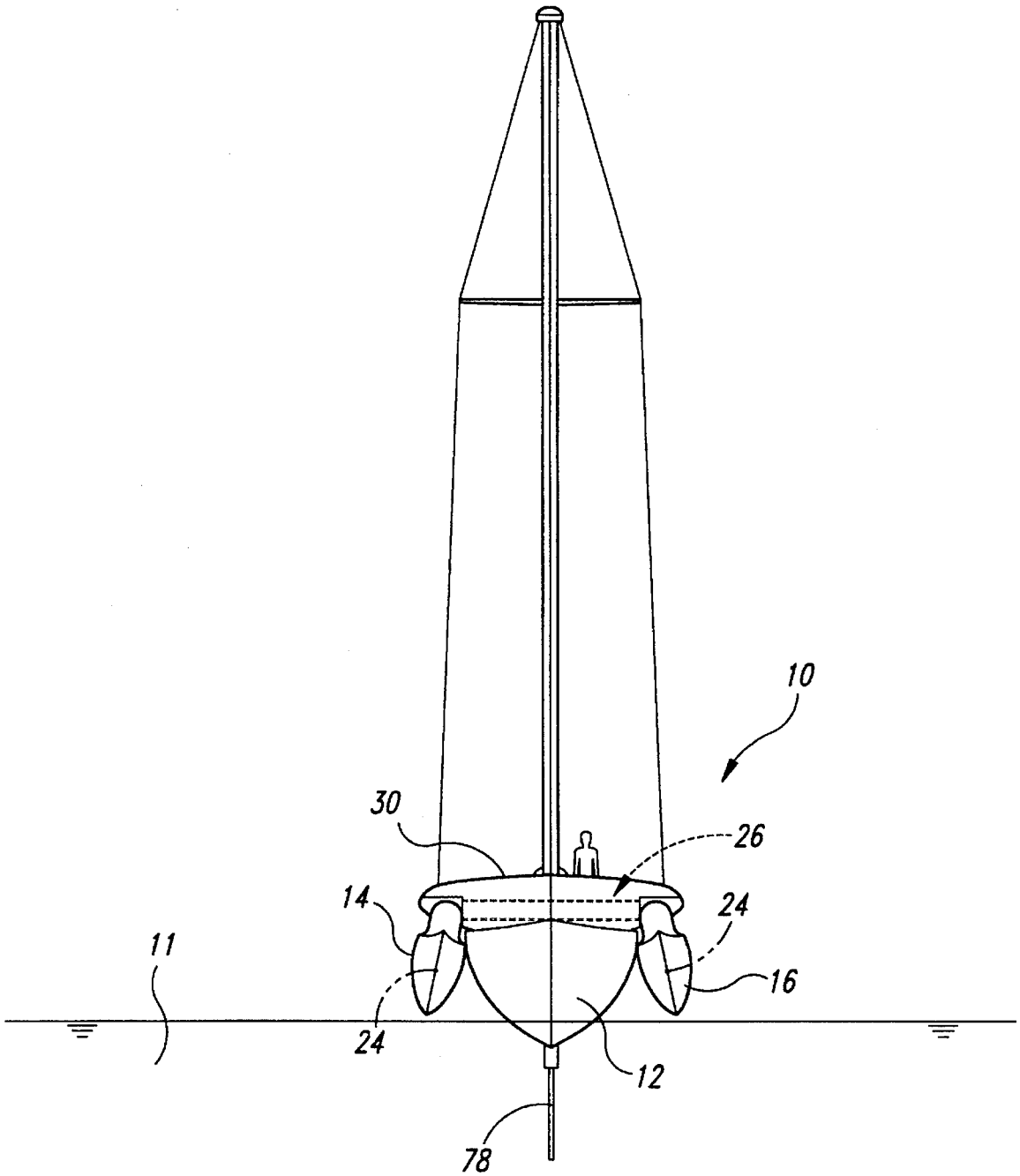
FIG. 3 is a rear side elevation view of the marine vessel of FIG. 1 with the outer hulls shown in a nested position immediately adjacent to the center hull.

The left outer hull 16 and the right outer hull 14 each have a longitudinal axis 24 that extends fore and aft along the length of their respective outer hull, and the longitudinal axes are generally parallel with the longitudinal axis 18 of the center hull. As best seen in FIG. 2, the left and right outer hulls 16 and 14 are securely connected to the center hull 12 by extendible support assemblies 26 that span between the center hull and the left and right outer hulls. The extendible support assemblies 26 are movable laterally relative to the center hull 12 between extended positions, shown in FIG. 2, and retracted positions, shown in FIG. 3. As discussed in greater detail below, the extendible support assemblies 26 position the left and right outer hulls 16 and 14 in outward positions away from the center hull 12 when the support members are in the extended positions, as shown in FIG. 2, and in nested positions with the left and right hulls immediately adjacent to the center hull when the extendible support assemblies are in the retracted positions, as shown in FIG. 3.

In the illustrated embodiment, the left and right outer hulls 16 and 14 are areas that provide planing surfaces on which the trimaran 10 will plane when the vessel travels over the water 11 at a sufficient speed.

Figure 4:
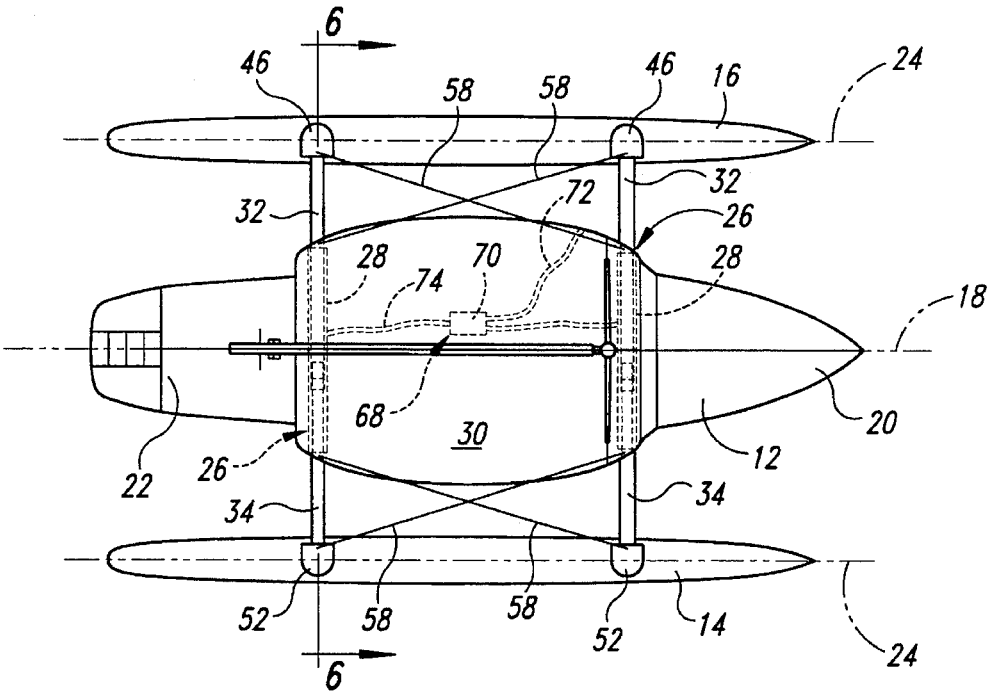
FIG. 4 is a top plan view of the multi-hull marine vessel of FIG. 1, with the outer hulls shown in the extended position.
Figure 5:
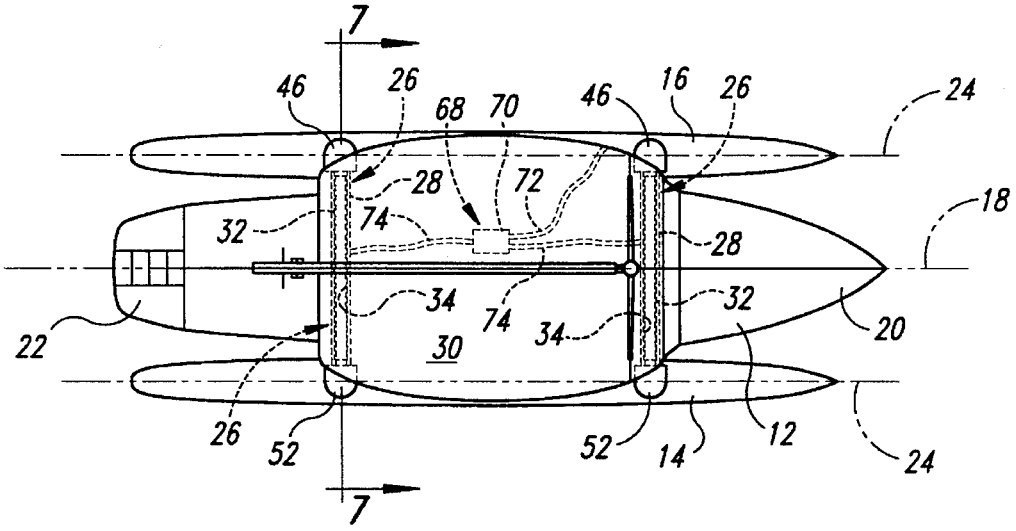
FIG. 5 is a top plan view of the multi-hull marine vessel of FIG. 1 with the outer hulls shown in the nested position.

As best seen in FIGS. 4 and 5, the extendible support members 26 attached to the center hull 12 includes a forward set of extendible support members near the bow 20 and a rear set of support members near the stem 22. Each of the forward and rear sets of extendible support members 26 in the preferred embodiment have a center sleeve 28 connected to the upper deck 30. In the preferred embodiment, the center sleeves 28 are secured within apertures integrally formed in the upper deck 30 of the center hull 12, such that the top surface of the upper deck extends over the top of the center sleeves 28 and is generally flat along its entire length. The center sleeves 28 are oriented on the upper deck 30 so as to be generally transverse to the longitudinal axis 18 of the center hull 12, and the center sleeves extend between the left and right sides of the center hull. The center sleeves 28 slidably receive left and right support members 32 and 34, which attach at their outer ends to the left or right outer hulls 16 and 14, respectively. The forward and rear sets of extendible support members 26 are substantially the same shape and size on the trimaran 10, and thus only the rear set will be discussed in detail with the description and discussion being equally applicable to the forward set.

Figure 6:
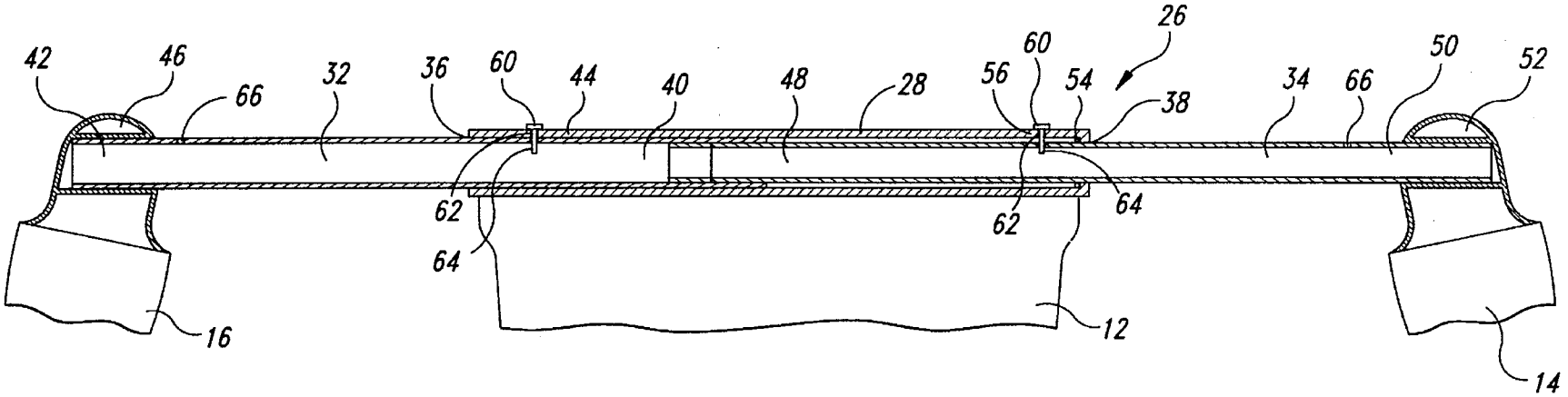
FIG. 6 is an enlarged cross-sectional view taken substantially along line 6—6 of FIG. 4 showing extendible support members spanning between the center and outer hulls with the outer hulls in the outward position.
Figure 7:
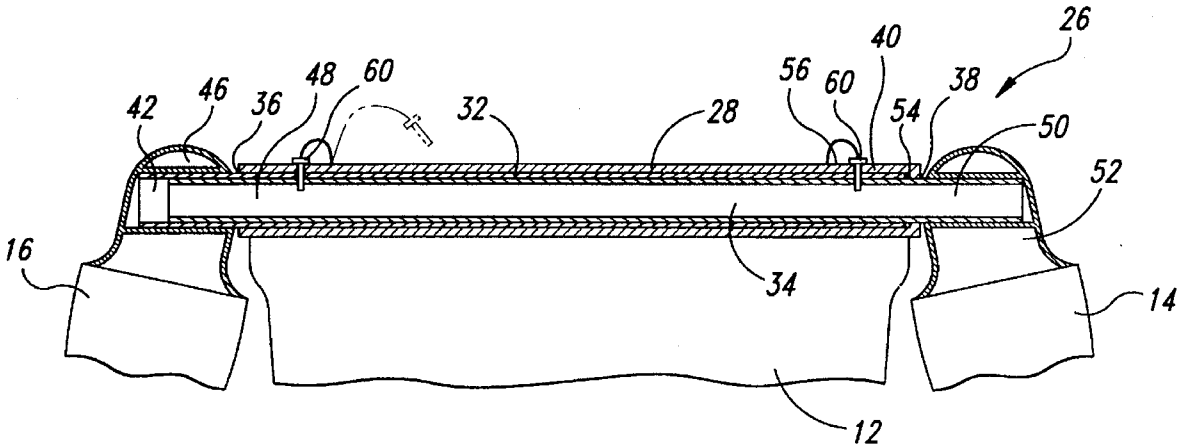
FIG. 7 is an enlarged cross-sectional view taken substantially along line 7—7 of FIG. 5 showing the extendible support members spanning between the center and outer hulls with the outer hulls in the nested position.

As best seen in FIGS. 6 and 7, the center sleeve 28 is an elongated tubular member that has an open left end 36 and an open right end 38. The open left end 36 of the center sleeve 28 receives a first end portion 40 of the left support member 32 such that the first end portion is slidably disposed within the center sleeve. A second end portion 42 of the left support member 32 opposite the first end portion 40 is securely mounted to the top of the left outer hull 16.

The left support member 32 is axially aligned with the center sleeve 28 and the left support member is movable relative to the center sleeve between the extended position, shown in FIG. 6, and the retracted position, shown in FIG. 7. In the extended position, the first end portion 40 of the left support member 32 is located within the center sleeve 28 adjacent to an outer left portion 44 of the center sleeve. In this position the second end portion 42 of the left support member 32 is located outward away from the left end portion 44 of the center sleeve 28. As the left support member 32 moves from the extended position toward the retracted position, the left support member slides within the center sleeve 28 and the first end portion 46 of the left support member moves toward the open right end 38 of the center sleeve. In the retracted position, shown in FIG. 7, the second end portion 42 of the left support member 32 is positioned adjacent to the left end portion 44 of the center sleeve 28 and just outward of the open left end 36 of the center sleeve.

When the left support member 32 is in the retracted position, as best seen in FIGS. 3, 5 and 7, the left outer hull 16 is located immediately adjacent to the left sidewall of the center hull 12 and is in the nested position. Accordingly, the left outer hull 16 can be tucked in along the center hull 12 by retracting the left support member 32 from the extended position to the retracted position. When the left support member 32 is in the extended position, as best seen in FIGS. 2, 4 and 6, the left outer hull 16 is located away from the center hull 12 and is in the outward position. The left outer hull 16 is attached to the second end portion 42 of the left support member 32 by a mounting bracket 46 that is mounted to the top of the left outer hull. The mounting bracket 46 is shaped and sized to support the left outer hull 16 at an angle relative to the center hull 12, as best seen in FIG. 2, such that the left outer hull is generally perpendicular to the body of water 11 when the trimaran 10 is heeled over and the left outer hull is partially within the water. In this heeled position, the right outer hull 14 is carried by the right support member 34 and is out of the water.

The bracket 46 is attached to the top of the left outer hull 16 in a conventional manner that is known in the art.

On the right side of the trimaran 10, the right support member 34 is slidably received in the center sleeve 28 through the open right end 38 such that a first end portion 48 of the right support member is slidably disposed within the center sleeve. A second end portion 50 of the right support member 34 is opposite the first end portion 50 and is securely mounted to the top of the right outer hull 14 with a mounting bracket 52 that is similar to the mounting bracket 46 on the left outer hull 16 described above. Thus, the right outer hull 14 is secured at an angle relative to the center hull 12 so the right outer hull is generally perpendicular to the body of water 11 when the trimaran is heeled over to the right and the left outer hull 16 is carried by the left support member 32 out of the water.

The right support member 34 is axially aligned with the center sleeve 28 and with the left support member 32. The left support member 32 is also a tubular member that is shaped and sized to receive the first end portion 48 of the right support member 34, such that the right support member is slidably disposed within the center sleeve 28 and within the left support member 32. The right support member 34 is movable between the extended position as best seen in FIGS. 2, 4 and 6, and in the retracted position, as best seen in FIGS. 3, 5, and 7. When the right support member 34 is in the retracted position, the first end portion 48 of the right support member is adjacent to the second end portion 42 of the left support member 32. In this retracted position, the second end portion 50 of the right support member 34 is adjacent to the open right end 38 of the center sleeve 28 and the right outer hull 14 is in the nested position, such that the right outer hull is tucked in adjacent to the right sidewall of the center hull 12.

When the right support member 34 is in the extended position, the second end portion 50 of the right support member is located away from the open right end 38 of the center sleeve 28, and the first end portion 48 is located within the first end portion 40 of the left support member 32. As best seen in FIGS. 2, 4 and 6, the right outer hull 14 is located in an outward position away from the center hull 12 when the right support member 34 is in the extended position. As the right support member 34 is moved from the extended position toward the retracted position, the first end portion 48 slides within the left support member 32 away from the second end portion 42 of the left support member.

An internal spacer sleeve 54 having approximately the same thickness as the tubular left support member 32 is located within a right end portion 56 of the center sleeve 28. The spacer sleeve 54 receives and supports the right support member 34. The spacer sleeve 54 keeps the right support member 34 co-axially aligned with the left support member 32 and the center sleeve 28, thereby preventing the left and right support members from skewing relative to each other. Such skewing would prevent the left and right support members 32 and 34 from sliding relative to each other and relative to the center sleeve 28.

Accordingly, the left and right support members 32 and 34 are attached to the left and right outer hulls 16 and 14, respectively, and they are slidably disposed within the center sleeve 28, such that the left and right support members move telescopically within the center sleeve, thereby resulting in telescoping extendible support members that move the left and right hulls linearly in a direction transverse to the longitudinal axis of the center hull between the outward and nested positions. The longitudinal position of the left and right outer hulls 16 and 14 relative to the center hull 12 does not change as the outer hulls move between the outward and nested positions. As a result, the left and right outer hulls 16 and 14 remain as structural members of the trimaran 10 when in the nested position, so the trimaran can be sailed with the left and right outer hulls in any position between the outward and nested positions.

Although the preferred embodiment has extendible support members that are adapted to move telescopically between the retracted and extended positions to move the left and right outer hulls 16 and 14 between the outward and nested positions, other assemblies can be used to provide for such movement of the left and right outer hulls. For example, the extendible support assemblies 26 could be rack and pinion assemblies or other linearly extendible assemblies. The extendible support assemblies could also be scissor-type assemblies having arm members that pivot and bend relative to the center hull and relative to each other to allow for the movement of the left and right outer hulls.

As indicated above, each of the left and right outer hulls 16 and 14 are movably attached to this center hull 12 by the forward and rear extendible support assemblies 26. For example, in order to move the left hull 16 between the outward position, as illustrated in FIGS. 2 and 4, and the nested position, as illustrated in FIGS. 3 and 5, the left support member 32 on each of the forward and rear extendible support assemblies 26 are moved simultaneously relative to the center sleeves. This simultaneous movement of the extendible support assemblies 26 on the same side of the center hull 12 keeps the left or right outer hull 16 or 14, respectively, parallel to the center hull 12 and prevents the left support members 32 from binding with the center sleeve 28 or the right support members 34, which would then prohibit the movement of the outer hull relative to the center hull.

The extendible support assemblies 34 are configured so the left and right hulls 16 and 14 can be moved either simultaneously or independently between the outward and nested positions. Thus, the left outer hull 16 can be in any position between the outward and nested positions without regard to the relative position of the right outer hull 14. However, in the preferred embodiment, the left and right outer hulls are moved simultaneously.

As best seen in FIG. 4, stabilizers 58 are connected to the center hull 12 and to each of the left and right outer hulls 16 and 14. The stabilizer 58 stabilize the left and right outer hulls 16 and 14 and restrict longitudinal movement of the outer hulls relative to the center hull 12, thereby reducing twisting forces that are exerted on the extendible support assemblies 16. Such twisting forces are typically generated when the left and right outer hulls 16 and 14 are in the outward position and the trimaran 10 is moving through the water. In the illustrated embodiment, the stabilizers 58 are cables that are secured at one end to the center hull 12 and secured at opposite ends to the mounting brackets 46 or 52, such that the cables criss-cross in the area defined by the center hull, the support members, and the outer hull. Although the illustrated embodiment uses crossing cables as the stabilizers 58, other types of stabilizers may be used to achieve the stabilization of the outer hulls 16 and 14, while allowing the outer hulls to move between the outward and nested positions.

As best shown in FIG. 6, locking mechanisms 60 are mounted to the outer ends of each center sleeve 28. The locking mechanisms 60 releasably engage the left and right support members 32 and 34 to lock the support members in a selected position relative to the center sleeve 28 and to the center hull 12. Thus, the locking mechanisms 60 prevent the left and right support members 32 and 34 from inadvertently moving between the extended and retracted positions relative to the center sleeve.

In the illustrated embodiment, the locking mechanism 60 is a locking pin that extends through apertures in the center sleeve 28 and through co-axially aligned apertures in the left and right support members 32 and 34. The center sleeve 28 has an aperture 62 in each of the left and right end portions that is sized to receive the shaft 64 of the locking pin. The left and right support members 32 and 34 each have apertures 66 in the first and second end portions of the support members, and the apertures 66 are positioned to co-axially align with the apertures 62 in the center sleeve 28 when the left and right support members are in the extended position and in the retracted position, respectively. Accordingly, the locking pin can be inserted through the aligned apertures 62 and 66 when the left and right outer hulls 16 and 14 are in either the outward position or the nested position.

In an alternative embodiment not illustrated, each of the left and right support members 32 and 34 have a plurality of apertures therein that align with the apertures 62 in the center sleeve 28. The plurality of apertures allows the left and right support members 32 and 34 to be locked in any one of a plurality of positions between the extended and retracted positions, thereby locking the left and right outer hulls 16 and 14 in one of a plurality of positions between the outward and nested positions. In another alternate embodiment, the locking mechanisms 60 are electromechanical devices that releasably engage the left and right support members 32 and 34 and prevent undesired movement of the left and right support members relative to the center sleeve 28. The electromechanical devices are controlled by an electric switch that can be activated from, for example, the cockpit of the trimaran 10 and can lock the left and right support members 32 and 34 at any one of a plurality of positions between the extended and retracted positions.

The left and right outer hulls 16 and 14 are moved between the outward position shown in FIG. 4 and the nested position shown in FIG. 5 by a hydraulic moving system 68 having a pump 70 mounted to the center hull 12, and hydraulic lines 72 that connect to the pump and to the extendible support assemblies 26. The pump 70 is also connected to a water supply line 74 that draws water from the body of water 11, and the water is carried through the hydraulic lines 72 to the extendible support assemblies 26. The extendible support assemblies 26, including the center sleeves 28 and the left and right support members 32 and 34 generally seals at the interfaces between the members.

To move the left and right outer hulls 16 and 14 from the nested position to the outward position, the pump 70 is activated and pumps water into the extendible support assemblies 26 until the water exerts a positive pressure on the left and right support members 32 and 34. The resulting pressure from the water forces the left and right support members 32 and 34 outward toward the extended position, thereby moving the left and right hulls 16 and 14 toward the outward position. To move the left and right outer hulls 16 and 14 from the outward position to the nested position, the pump 70 withdraws the water from the extendible support assemblies 26 and creates a negative pressure within the extendible support assemblies that draws the left and right support members 32 and 34 toward the retracted position, such that the outer hulls are drawn inward toward the nested position. The water drawn from the support assemblies 26 is discharged into the body of water 11. As such, the position of the left and right hulls 16 and 14 relative to the center hull 12 can be controlled by the pump 70.

In an alternate embodiment, pneumatic system moves the left and right outer hulls 16 and 14 between the outward and nested positions, wherein pressurized air is used to create positive and negative pressures in the extendible support assemblies 26 that move the left and right support members 32 and 34 between the extended and retracted positions. In another alternate embodiment, not shown, the left and right outer hulls 16 and 14 are moved between the outward and nested positions by a motor and rod system. In this embodiment, rods or the like extend between the motor and the outer hulls, and the motor pushes and pulls the rods which, in turn, push and pull the left and right support members to move the outer hull to a selected position. Although the hydraulic moving system, the pneumatic moving system, and the motor and rod moving system have been discussed for illustrative purposes, other moving systems could be used to move and position the outer hulls 16 and 14 relative to the center hull 12, thereby providing a fully adjustable or partially adjustable positioning system for the outer hulls.

As indicated above, the retractable left and right outer hulls 16 and 14 allow a user of the trimaran 10 to increase or decrease the beam of the trimaran. The beam is decreased when the left and right outer hulls 16 and 14 are moved to the nested position, as is typically done to right the vessel if it overturns, or to moor the boat in a moorage slip or to increase the maneuverability of the boat when it is in tight areas. When the beam is decreased, the ultimate stability of the trimaran is increased and the initial stability is decreased, thereby making the trimaran 10 easier to right from an overturned position. The beam is increased when the left and right outer hulls 16 and 14 are moved to the outward position, which is typically done when the trimaran 10 is on open water, thereby achieving the stability, speed, and other benefits provided by the extended outer hulls. When the beam is increased, the trimaran's ultimate stability is decreased, and the initial stability is increased, such that the trimaran 10 is very stable in the upright position and difficult to overturn.

Figure 8:
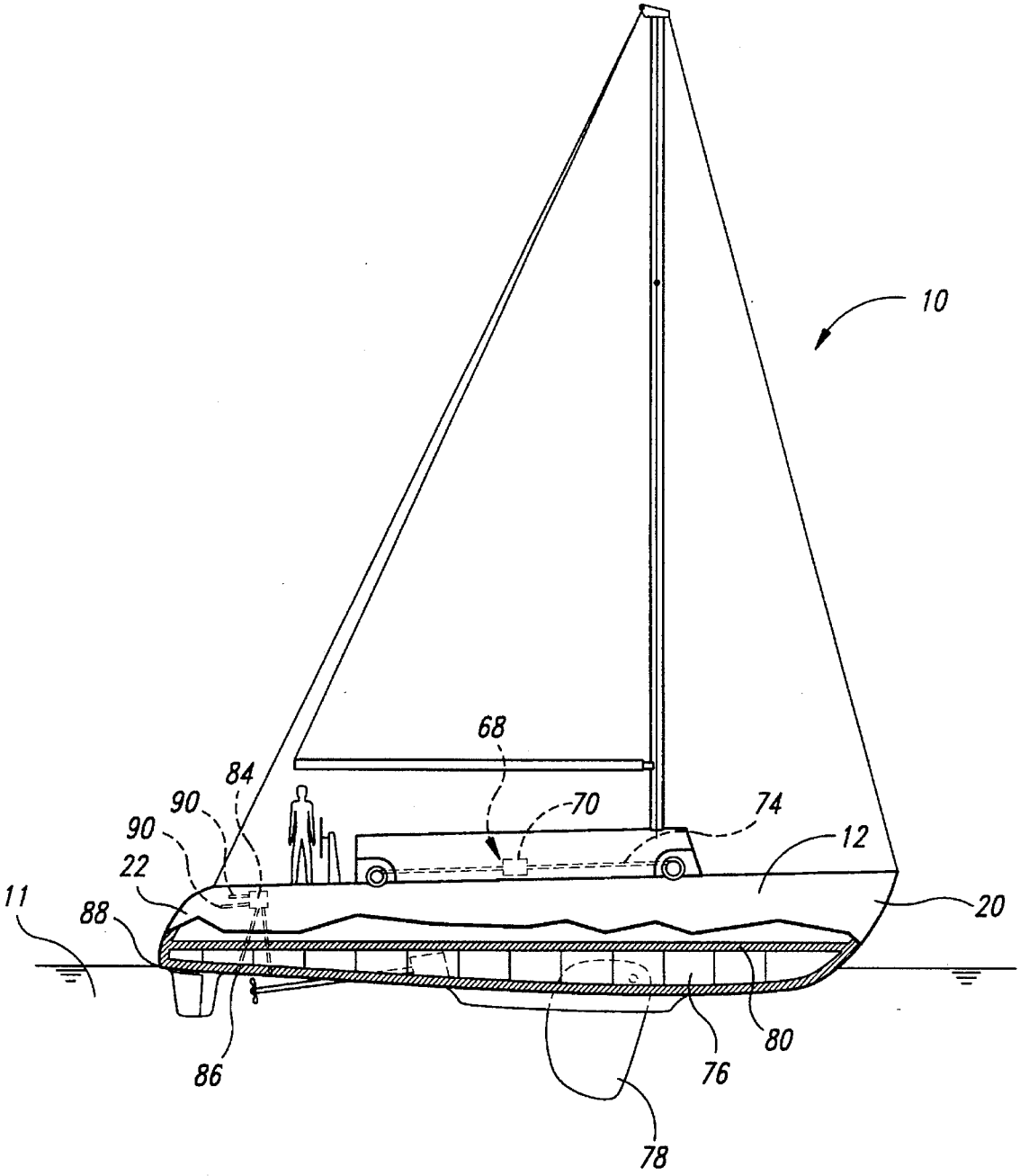
FIG. 8 is a cross-sectional view taken substantially along line 8—8 of FIG. 2. with the center hull partially cut away showing a water ballast tank.
Figure 9:
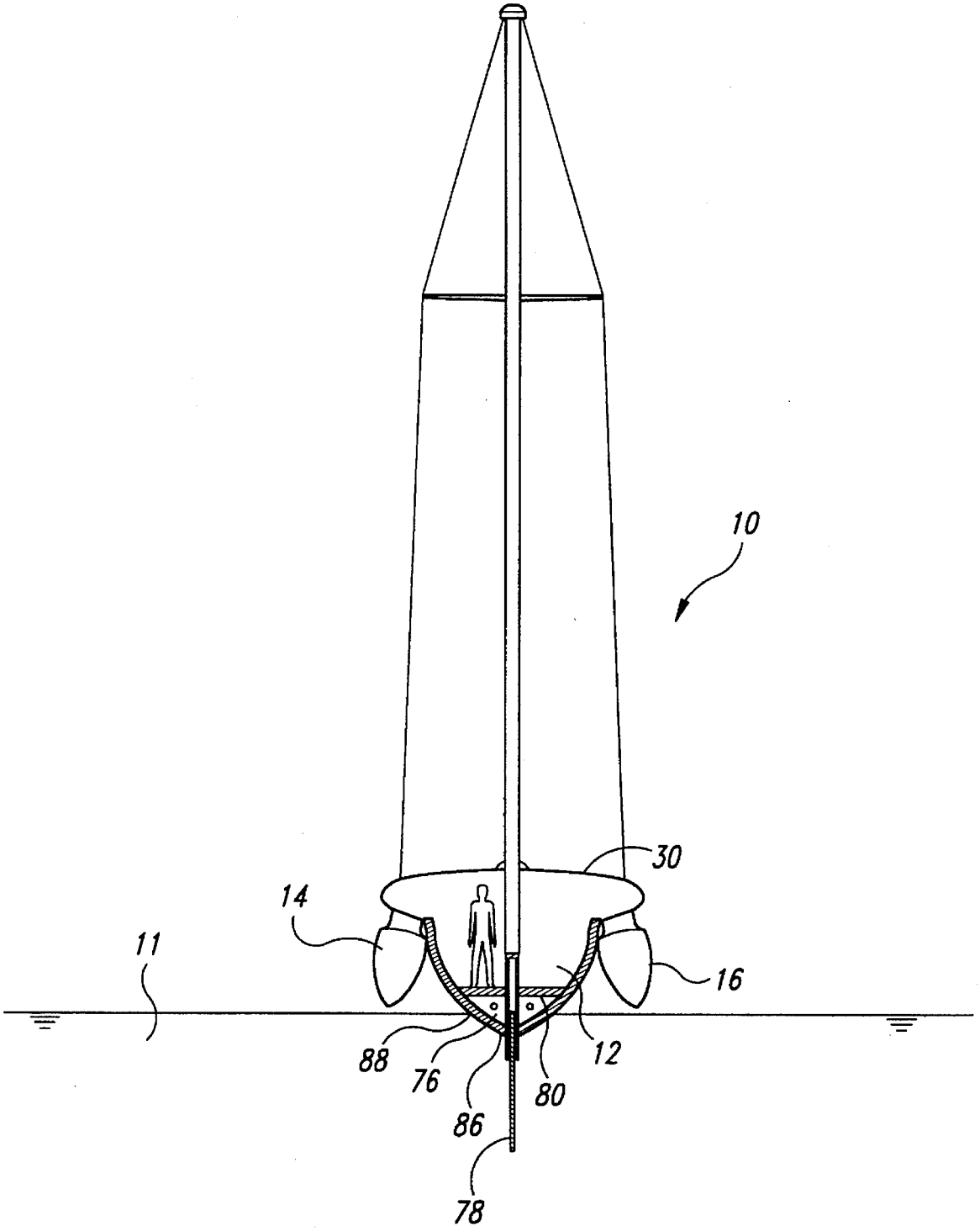
FIG. 9 is cross-sectional view taken substantially along line 9—9 of FIG. 1 showing the water ballast tank.

As best seen in FIGS. 8 and 9, the center hull 12 has a water ballast tank 76 located within the center hull 12 above a keel 78 and below the floorboards 80. The floorboards 80 are interconnected to create a sealed floor of the trimaran 10 that sealably attaches to the sidewalls 82 to form a watertight compartment that defines the water ballast tank 76. The water ballast tank 76 extends longitudinally along the bottom of the center hull 12 between the bow 20 and the stern 22. The size of the water ballast tank 76, in one embodiment of the invention, has a volume that will hold water weighing approximately 80% of the trimaran's weight. The size of the water ballast tank 76 can be increased or decreased during construction of the vessel to increase or decrease the tank's holding capacity. In an alternative embodiment of the invention, the water ballast tank 76 holds a volume of water that is over 100% of the trimaran's weight.

A pump 84 mounted on the center hull 12 is coupled to the water ballast tank 76 and is adapted to pump water into and out of the ballast tank as needed to achieve a desired ballast in the bottom of the center hull. The pump 84 draws water from the body of water 11 into the water ballast tank 76 through a primary intake valve 86 that is located below the water line 88 when the trimaran 10 is upright. Secondary intake valves 90 coupled to the pump 84 are located in the center hull 12 in a position such that they are above the water line 88 when the trimaran 10 is in the upright position, and located so at least one of the secondary intake valves will be below the water line when the trimaran is capsized, inverted, or otherwise overturned. Thus, the pump 84 floods the water ballast tank 76 when, for example, the trimaran 10 is right-side up with the outer hulls 16 and 14 in the nested position in order to increase the vessel's ultimate stability. The pump 84 is also used to flood the water ballast tank 76 when the trimaran 10 is overturned, thereby substantially increasing the weight of the bottom portion of the center hull 12 so as to facilitate in righting the trimaran, as discussed in greater detail below.

Each of the left and right outer hulls 16 and 14 is a sealed hull with positive buoyancy such that the hull provides sufficient buoyancy to prevent the trimaran 10 from sinking if, for example, the center hull 12 is completely flooded and ballasted with a full water ballast tank 76 is flooded. As a result, the trimaran 10 is an unsinkable ballasted marine vessel. The buoyancy provided be each of the outer hulls 16 and 14 is enhanced by using water as the ballast, because a water ballast is neutrally buoyant and will not try to pull the vessel toward the bottom of the body of water 11.

The retractable left and right outer hulls 16 and 14 and the water ballast tank 76 provide for a self-righting trimaran 10 if the trimaran overturns. For example, if the trimaran 10 has the outer hulls 16 and 14 in the outward position and the vessel is overturned, the hydraulic moving system 68 is activated and the pump 70 draws the water out of the extendible support assemblies 26 so as to retract the left and right outer hulls 16 and 14 to the nested position, thereby reducing the length of the beam and reducing the initial stability of the vessel. Thus, the vessel is configured to have a beam-to-length ratio and an initial stability that is similar to a conventional mono-hull boat. In addition, the water ballast tank 76 is filled by activating the ballast pump 84 and drawing water through at least one of the secondary intake valves 90. The weight of the water in the water ballast tank 76 is located such that the center of gravity of the trimaran 10 is above the surface of the water 11 and is not in an equilibrium position. Thus, the trimaran 10 will tend to roll from the overturned position toward the upright position until the center of gravity is in the equilibrium position, below the surface of the water, thereby causing the trimaran to right itself.

Once the trimaran 10 has righted itself with the full water ballast tank 76, the left and right outer hulls 16 and 14 are moved from the nested position to the outward position to provide the vessel with a high initial stability which has the additional stability of the full water ballast tank in the bottom portion of the center hull 12. In this stable position, the trimaran can motor or otherwise move to safer or less rough waters. Accordingly, the trimaran 10 of the present invention is a self-righting vessel that is very versatile and obtains the benefits experienced by having a configuration of a wide beam vessel and as a narrow beam vessel.

While various embodiments have been described in this application for illustrative purposes, the claims are not limited to the embodiments described herein. Equivalent devices or steps may be substituted for those described, which operate according to the principles of the present invention and thus fall within the scope of the claims. Therefore, it is expressly to be understood that the modifications and variations and equivalents thereof made to the multi-hull marine vessel with retractable outer hulls be practiced while remaining within the spirit and scope of the invention as defined in the following claims.

I claim:

1. A method of righting an overturned multi-hull marine vessel from an overturned position, the multi-hull marine vessel having a first hull and a second hull connected to the first hull with a movable support member, the first hull having a bottom portion and a water ballast tank in the bottom portion, the second hull being positioned in an outward position away from the first hull, comprising the steps of:

moving the second hull relative to the first hull from the outward position to a nested position with the second hull being located immediately adjacent to the first hull, the second hull being moved when the multi-hull marine vessel is in the overturned position;

filling the water ballast tank with water to provide ballast to the vessel; and rotating the first and second hulls as a unit from the overturned position to a righted upright position.

2. The method of righting an overturned multi-hull marine vessel of claim 1 further comprising the step of moving the second outer hull relative to the first hull from the nested position to the outward position when the first and second hulls are in the righted position.

3. The method of righting an overturned multi-hull marine vessel of claim 2 further comprising the step of substantially emptying the water from the water ballast tank when the first and second hulls are in the righted position.

* * * * *